US008928468B2

(12) United States Patent
Ullrich

(10) Patent No.: US 8,928,468 B2
(45) Date of Patent: Jan. 6, 2015

(54) METHOD AND SYSTEM FOR LINE-OF-SIGHT-INDEPENDENT DATA TRANSMISSION

(75) Inventor: Christoph Ullrich, Schweitenkirchen (DE)

(73) Assignee: Audi AG, Ingolstadt (DE)

( * ) Notice: Subject to any disclaimer, the term of this patent is extended or adjusted under 35 U.S.C. 154(b) by 155 days.

(21) Appl. No.: 13/369,865

(22) Filed: Feb. 9, 2012

(65) Prior Publication Data

US 2013/0038433 A1 Feb. 14, 2013

(30) Foreign Application Priority Data

Feb. 10, 2011 (DE) ..... 10 2011 010 846

(51) Int. Cl.
*B60Q 1/00* (2006.01)
*G08G 1/16* (2006.01)
*H01Q 15/00* (2006.01)

(52) U.S. Cl.
CPC ..... *G08G 1/161* (2013.01); *G08G 1/164* (2013.01); *H01Q 15/00* (2013.01)
USPC ..... 340/425.5; 340/928; 340/929; 340/930; 455/19

(58) Field of Classification Search
USPC ..... 340/425.5, 928–930; 455/19, 120, 502, 455/575
See application file for complete search history.

(56) References Cited

U.S. PATENT DOCUMENTS

| | | | | |
|---|---|---|---|---|
| 5,994,984 | A * | 11/1999 | Stancil et al. | 333/248 |
| 6,487,423 | B1 | 11/2002 | Johansson | |
| 2003/0124976 | A1 * | 7/2003 | Tamaki et al. | 455/15 |
| 2007/0021095 | A1 * | 1/2007 | Cheng et al. | 455/403 |
| 2008/0020706 | A1 * | 1/2008 | Payne et al. | 455/41.2 |
| 2011/0045764 | A1 * | 2/2011 | Maruyama et al. | 455/7 |
| 2011/0187560 | A1 * | 8/2011 | Stahlin | 340/928 |
| 2012/0206299 | A1 * | 8/2012 | Valdes-Garcia | 342/359 |

FOREIGN PATENT DOCUMENTS

| | | | |
|---|---|---|---|
| DE | 33 33013 | A1 | 3/1985 |
| DE | 37 12079 | A1 | 10/1988 |
| DE | 295 21 019 | | 9/1996 |
| DE | 10 2006 019 170 | A1 | 10/2007 |
| DE | 10 2007 042 792 | A1 | 3/2009 |
| DE | 10 2007 052 993 | A1 | 5/2009 |
| DE | 10 2008 015 778 | B4 | 8/2009 |
| DE | 10 2010 029 483 | A1 | 1/2011 |
| EP | 0 000 447 | A1 | 1/1979 |
| EP | 21 78 064 | A1 | 4/2010 |
| JP | 2005 17 42 37 | A | 6/2005 |

* cited by examiner

*Primary Examiner* — Hai Phan
*Assistant Examiner* — Ojiako Nwugo
(74) *Attorney, Agent, or Firm* — Henry M Feiereisen LLC

(57) ABSTRACT

In a method for line-of-sight-independent data transmission in a car-to-car or a car-to-infrastructure communication system, electromagnetic radiation having encoded data is transmitted from a transmitter located in a first vehicle or in a traffic infrastructure object, and a reflector system is provided for at least partially reflecting the transmitted electromagnetic radiation, wherein the reflector system is arranged so that the transmitted electromagnetic radiation arrives at a receiver located in a second vehicle or in the traffic infrastructure object. The reflected electromagnetic radiation having the encoded data can then be received by the receiver even when line-of-sight communication between the vehicles is impossible.

13 Claims, 3 Drawing Sheets

METHOD AND SYSTEM FOR LINE-OF-SIGHT-INDEPENDENT DATA TRANSMISSION

CROSS-REFERENCES TO RELATED APPLICATIONS

This application claims the priority of German Patent Application, Serial No. 10 2011 010 846.7, filed Feb. 10, 2011, pursuant to 35 U.S.C. 119(a)-(d), the content of which is incorporated herein by reference in its entirety as if fully set forth herein.

BACKGROUND OF THE INVENTION

The present invention relates to a method for line-of-sight-independent data transmission from a transmitter to a receiver in a car-to-car or a car-to-infrastructure communication system. The present invention also relates to a system for line-of-sight-independent data transmission.

The following discussion of related art is provided to assist the reader in understanding the advantages of the invention, and is not to be construed as an admission that this related art is prior art to this invention.

Car-to-X (car-to-car and/or car-to-infrastructure) communication services for use in future road vehicles are known in the art. These communication services allow the exchange of data and information between motor vehicles and between motor vehicles and traffic installations. The communication standard is standardized in IEEE 802.11p. The communication among vehicles and between vehicles and infrastructure should be mainly employed to alert following, oncoming and merging traffic to dangerous situations. A possible scenario is, for example, to alert road users of fast moving emergency vehicles with flashing blue light, to prevent possible collisions at traffic light when the emergency vehicle crosses at a red light.

Because communication with the IEEE 802.11p standard takes place at comparatively high frequencies of typically 5.8 GHz, so-called line-of-sight propagation is required for data exchange. This means that in many situations direct visual contact between the transmitter and receiver of the information must be established. If the direct visual contact is limited, for example due to buildings, communication is inadequate or may not be possible at all.

It would therefore be desirable and advantageous to obviate prior art shortcomings and to provide an improved, easily implementable method and a cost-effective and low-maintenance system for line-of-sight-independent data transmission from a transmitter to a receiver in road traffic.

SUMMARY OF THE INVENTION

According to one aspect of the present invention, a method for line-of-sight-independent data transmission in a car-to-car or a car-to-infrastructure communication system, includes transmitting electromagnetic radiation having encoded data from a transmitter located in a first vehicle or in a traffic infrastructure object, providing a reflector system configured to at least partially reflect the transmitted electromagnetic radiation, arranging the reflector system so that the transmitted electromagnetic radiation arrives at a receiver located in a second vehicle or in the traffic infrastructure object, and receiving with the receiver the reflected electromagnetic radiation having the encoded data.

In a car-to-car or car-to-infrastructure communication system, a motor vehicle may acquire its own driving data (speed, direction of movement, position, etc.) and provide these data via radio waves to other road users, for example motor vehicles, and/or traffic infrastructure objects (traffic light systems, traffic information display unit, traffic control center, etc.). The electromagnetic radiation may, in particular, include radio waves (e.g. WLAN, UMTS, etc.). The data encoded in the electromagnetic radiation may be data relating to the driving information of the vehicle, in which the sensor is installed.

According to one advantageous feature of the present invention, the reflector system may be configured such that it has a very high reflection coefficient for the particular frequency band of the electromagnetic radiation transmitted by the transmitter. The reflector system may be arranged such that the nominal reflection direction can be determined from the principal direction of incidence of the electromagnetic radiation emitted by the transmitter using the laws of geometric optics. Advantageously, transmitter and receiver in the respective vehicles can also be operated as receiver and transmitter.

This method is particularly easily implemented and employed in road traffic. It is only necessary to provide a suitable reflector device for installation at a suitable point and proper alignment. The reflection device does not require its own current supply, so that its operation should not incur any costs after initial installation. Due to its very simple construction, the reflection device requires almost no maintenance and may even be maintenance-free. A complex high-maintenance active node operating as receiver and re-transmitter can thus be eliminated, while nevertheless ensuring very reliable car-to-car and car-to-infrastructure communication. The method is robust and less prone to error.

According to another advantageous feature of the present invention, the reflector system may be arranged on a building bordering a traffic route. Alternatively or in addition, the reflector system may be arranged on a traffic light system, in particular at a traffic light. The reflector system may also be located in a curve or proximate to a curve of a traffic route. Finally, the reflector system may also be located at an intersection of several different traffic routes, for example in the center of an intersection. These positions for the reflector system advantageously ensure a simple, uncomplicated and reliable installation, while simultaneously ensuring reflection of the electromagnetic radiation into those areas where the vehicle with the receiver may be potentially located. No expensive and additional facilities, such as posts, columns, etc., are required for installation; instead, the reflector system may be arranged on objects which are either already in existence or which already serve other purposes, obviating the need for costly installation and redundancy.

According to one advantageous feature of the present invention, the reflection system the reflector system may be arranged at an intersection of a first and a second traffic route so as to reflect electromagnetic radiation transmitted substantially in the direction of the first traffic route substantially in the direction of the second traffic route. If the vehicle with the transmitter is on the first traffic route and the vehicle with the receiver on the second traffic route, then a reliable line-of-sight connection may not exist between the transmitter and the receiver due to the location of the point of intersection of the two traffic routes. For example, the line-of-sight connection may be interrupted by a building bordering the traffic routes between the first and the second traffic route. However, the reflector device then still allows a car-to-car communication between transmitter and receiver of the two vehicles, because the reflector device is arranged at the intersection of the two traffic routes. The beam angle of the electromagnetic radiation emitted by the transmitter may be changed by the reflector in a suitable manner so as to reflect the electromagnetic radiation towards the receiver. The reflector may have a strongly preferred direction. According to one advantageous feature of the present invention, the reflector may be constructed and arranged so that the angle between incident and reflected electromagnetic radiation is 90°. This embodiment is particularly advantageous at road crossings, where the traffic routes intersect at a 90° angle, wherein the reflector system may preferably be installed at the center of the road crossing.

According to another advantageous feature of the present invention, electromagnetic radiation may have a frequency in a range 4 to 7 GHz, in particular a frequency in a range 5.8 to 6 GHz. Particularly preferred is a frequency of 5.85 to 5.925 GHz. This range corresponds to the Dedicated Short Range Communication (DSRC) frequency band defined by the IEEE 802.11p standard. However, the electromagnetic radiation may have other frequencies within the frequency bands defined in the standard IEEE 802.11 or IEEE 802.11p. The frequency of the electromagnetic radiation employed with the method is then optimally adapted to the frequency bands employed in car-to-car or car-to-infrastructure communication systems.

According to another aspect of the invention, a system for line-of-sight-independent data transmission in road traffic includes a transmitter configured to transmit electromagnetic radiation with encoded data, said transmitter disposed in a first vehicle or in a traffic infrastructure project, a receiver configured to receive the electromagnetic radiation, wherein the receiver is disposed in a second vehicle or in the traffic infrastructure object, and a reflector system configured to at least partially reflect the transmitted electromagnetic radiation. The reflector system is arranged such that the electromagnetic radiation transmitted from the transmitter can reach the receiver.

According to an advantageous feature of the present invention, the reflector system may include at least one two-dimensional reflector element made of metal, for example sheet metal. The reflective system may be cost-effectively produced, for example, by welding sheet metal. This embodiment is extremely robust, mechanically stable, low-maintenance, weather resistant, less prone to errors, and at the same time guarantees very effective reflection of electromagnetic radiation.

According to another advantageous feature of the present invention, the reflector system may include at least three reflector elements which are arranged with respect to each other so as to form the outside surfaces of a pyramid or a cube. The pyramid and/or the cube may be arranged in particular with respect to traffic routes intersecting at right angles, so that the edges of the pyramid or the cube point in the direction of the traffic routes. This embodiment of the reflector system is advantageous for installation at the intersection of street crossings or T-crossings. The form of the reflector system may also be derived from a pyramid by constructing the reflector elements with the convex curvature. The incident electromagnetic radiation can then be reflected in many different directions.

BRIEF DESCRIPTION OF THE DRAWING

Other features and advantages of the present invention will be more readily apparent upon reading the following description of currently preferred exemplified embodiments of the invention with reference to the accompanying drawing, in which.

DETAILED DESCRIPTION OF PREFERRED EMBODIMENTS

Figure 1:
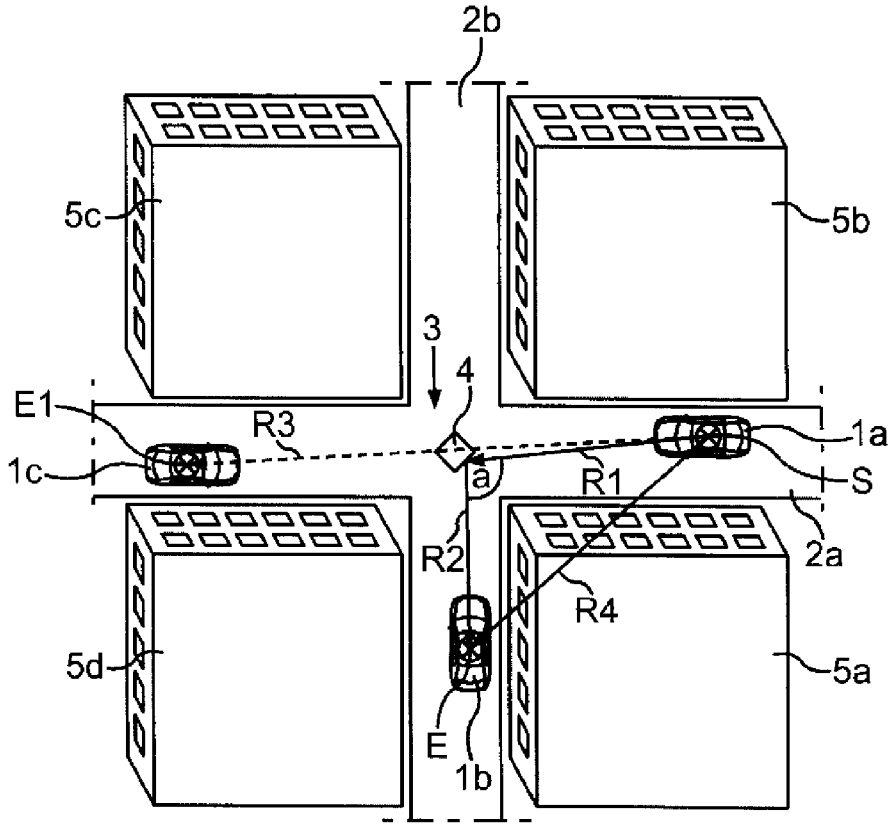
FIG. 1 shows a schematic top view of a street crossing with vehicles communicating with one another by way of a car-to-car communication.

Throughout all the figures, same or corresponding elements may generally be indicated by same reference numerals. These depicted embodiments are to be understood as illustrative of the invention and not as limiting in any way. It should also be understood that the figures are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted.

Turning now to the drawing, and in particular to FIG. 1, there is shown a top view of two streets 2*a* and 2*b* which intersect at an intersection 3 at right angles. The streets 2*a* and 2*b* are bordered on all sides by abutting buildings. The buildings 5*a*, 5*b*, 5*c* and 5*d* complicate or prevent direct line-of-sight connection between street sections formed by the streets 2*a* and 2*b*.

Altogether three motor vehicles 1*a*, 1*b* and 1*c* are positioned on the streets 2*a* and 2*b*. The motor vehicles 1*a* and 1*c* travel in opposite directions on the street 2*a* and have a direct line-of-sight connection with each other. Electronic communication systems, which are part of a car-to-car communication system, are installed in all motor vehicles 1 to 1*c*. These systems can operate as both transmitter and receiver for radio waves at the frequency 5.8 GHz. For example, the motor vehicle 1*a* determines its current position and speed and transmits these data wirelessly to other road users. For this purpose, the car-to-car communication system is available in the motor vehicle 1*a* which can transmit radio waves as transmitter S. A similar device operating as receiver E1 for this electromagnetic radiation is provided in the motor vehicle 1*c*. Because a direct line-of-sight connection exists between the motor vehicles 1*a* and 1*c*, data can be transmitted directly from transmitter S to receiver E1 via an electromagnetic radio beam R3.

Conversely, a direct line-of-sight connection does not exist between the motor vehicles 1*a* and 1*b*. The radio beam R4 transmitted from the transmitter S to a receiver E of the motor vehicle 1*b* cannot reach the receiver E because of the building 5*a*. The direct line-of-sight propagation is interrupted by the building 5*a*. However, it would be especially beneficial to exchange data between the motor vehicles 1*a* and 1*b* via car-to-car communication for preventing, for example, a collision between the two vehicles 1*a* and 1*b* at the intersection 3. To date, such communication is not easy achievable, because the radio contact is interrupted by the building 5*a*.

To nevertheless enable radio contact, a reflector system in form of a reflector pyramid 4 is installed in the center of the intersection 3, i.e. at the point of intersection of the streets 2*a* and 2*b*. This reflector pyramid is constructed to have a square base surface. The side faces forming the pyramid are formed by welded metal sheets capable of excellent reflection of the electromagnetic radiation of 5.8 GHz.

Figure 2:
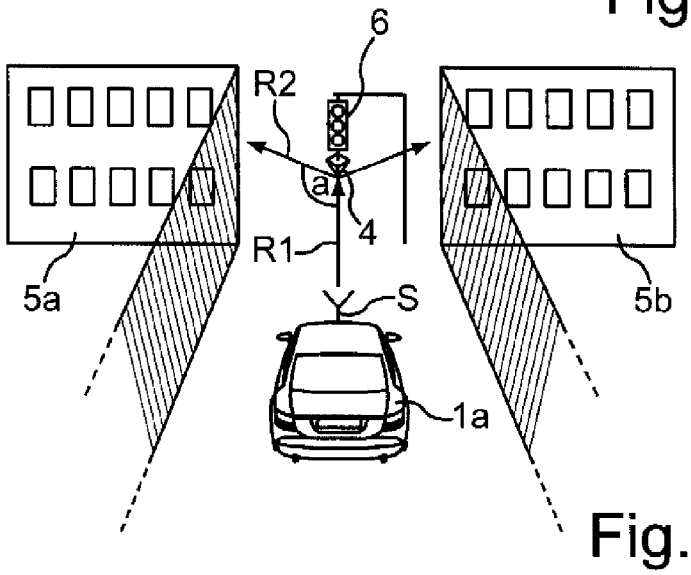
FIG. 2 shows a perspective view of a street section.

As illustrated in FIG. 2, the reflector pyramid 4 is installed at a traffic signal 6 such that at the point of intersection of the streets 2*a* and 2*b*, the tip of the pyramid points vertically towards the road surface. The reflector pyramid 4 is hereby oriented such that two of its edges point in the direction of the course of the road 2*a* and two of its edges in the direction of the course of the road 2*b*. The electromagnetic radiation transmitted from the transmitter S in the beam direction R1 is then incident on the reflector pyramid 4 where it is reflected at an angle a in the direction of the street 2*b*. The reflected radio beam is indicated with R2. This beam can now be readily received by the receiver E of the motor vehicle 1*b*. The radio beam R1 is deflected by the reflector pyramid 4 so as to be incident on the receiver E as radio beam R2, thus enabling car-to-car communication between the motor vehicles 1*a* and 1*b* in spite of the absence of a line-of-sight connection. The reflector system is in particularly oriented and/or constructed so as not to return the electromagnetic waves in the direction of incidence (as is the case with the topset) and not to distribute the radiation uniformly in space.

Figure 3A:
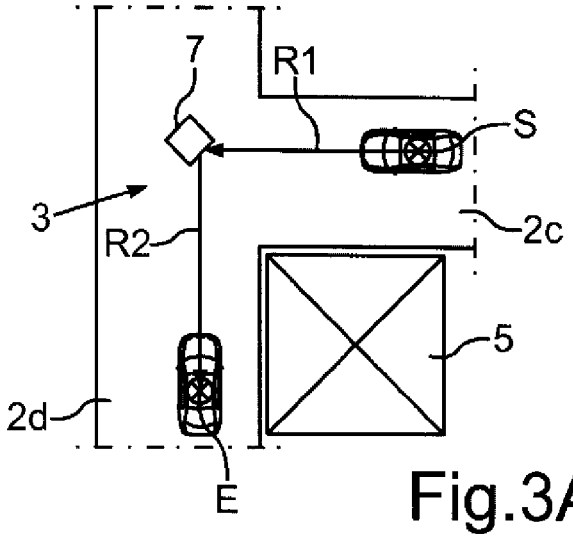
FIG. 3A shows a first exemplary embodiment of a possible installation of a reflector system according to the present invention.
Figure 3B:
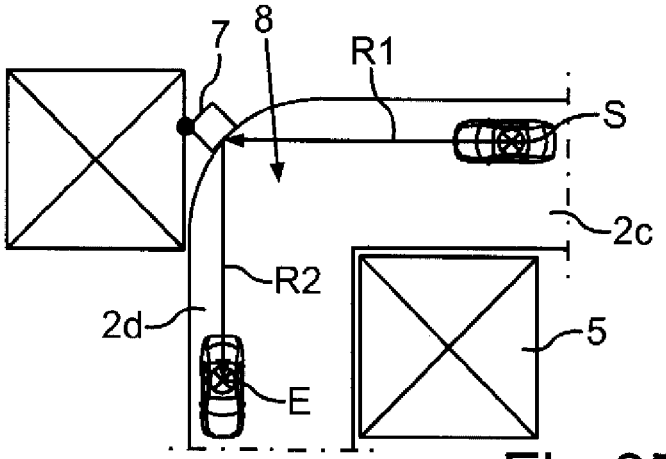
FIG. 3B shows a second exemplary embodiment of a possible installation of a reflector system according to the present invention.
Figure 3C:
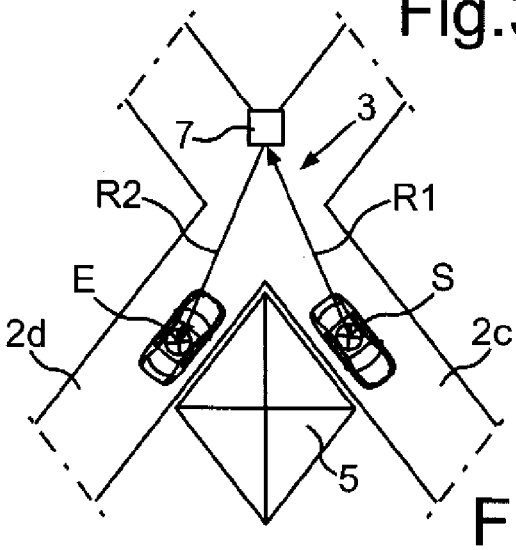
FIG. 3C shows a third exemplary embodiment of a possible installation of a reflector system according to the present invention.

FIGS. 3A to 3C show additional possible street configurations and arrangements of a reflector system. In these exemplary embodiments, the reflector system is constructed as a reflector cube, wherein the surfaces of the cube which are shown in FIGS. 3A to 3C in a top view need not necessarily be constructed from a reflecting material. However, the perpendicular side faces of the cube are again constructed from welded metal sheets. The intersection in FIG. 3A is constructed as a T-intersection of two streets 2*c* and 2*d*. Building 5 prevents direct radio communication between transmitter S and receiver E. However, the reflector cube 7 at the T-intersection point is aligned so that, according to the laws of geometric optics, the radio beam R1 emitted by the transmitter S is able to reach the receiver E as a reflected radio beam R2. This enables car-to-car communication.

FIG. 3B shows a curve 8 between the streets 2*c* and 2*d*, wherein a building 5 once more prevents direct radio communication between transmitter S and receiver E. The reflector cube 7 is here installed in the curve 8 on the bordering building 5*e*, again enabling a 90° reflection of the incident electromagnetic radiation, i.e. the beams R1 and R2 are perpendicular to each other.

FIG. 3C illustrates a situation where the streets 2*c* and 2*d* do not intersect each other at a right angle at the intersection 3. However, by suitably mounting the reflector cube 7, a geometric situation can be produced which allows the electromagnetic beam R1 emitted by the transmitter S to reach the receiver E as beam R2 after reflection at the reflector cube 7. It is evident that with the invention, the car-to-car communication is improved particularly near intersections in densely built-up areas.

Figure 4:
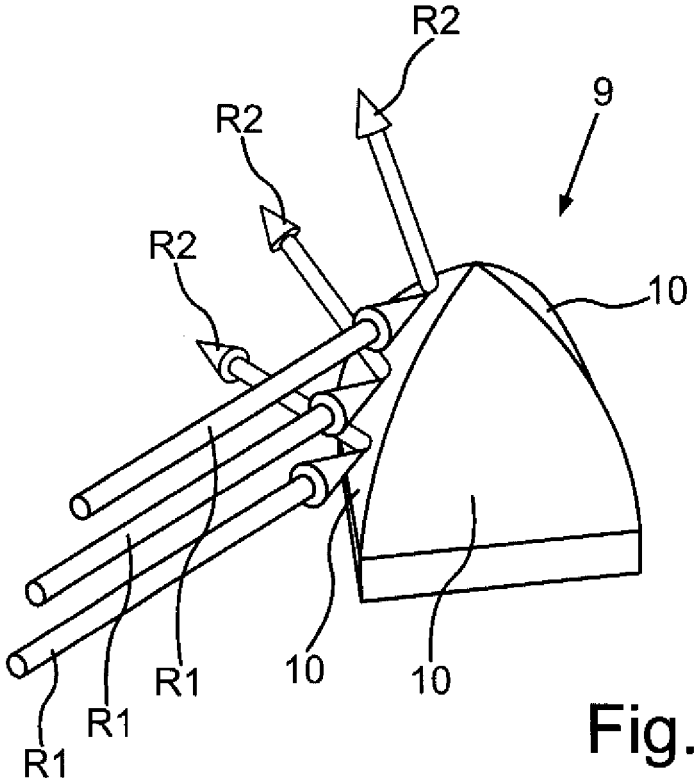
FIG. 4 shows an exemplary embodiment for a reflector system according to the present invention.

FIG. 4 shows another possible exemplary embodiment for a reflector system 9 which includes four curved convex reflector elements 10. As illustrated in the Figure, the incident beams R1 is then reflected not only in the horizontal direction, but also in the vertical direction. When this reflector system 9, like the reflector pyramid 4 in FIGS. 1 and 2, is installed at a traffic signal, excellent reception of the electromagnetic radiation R2 by the motor vehicle 1*b* can be ensured both when the motor vehicle 1*b* is far way from the traffic signal 6 and when the motor vehicle 1*b* is close to the traffic signal. In particular, excellent reception can also be ensured even when the motor vehicle 1*b* is already almost underneath the reflector system 9 on the intersection 3.

While the invention has been illustrated and described in connection with currently preferred embodiments shown and described in detail, it is not intended to be limited to the details shown since various modifications and structural changes may be made without departing in any way from the spirit and scope of the present invention. The embodiments were chosen and described in order to explain the principles of the invention and practical application to thereby enable a person skilled in the art to best utilize the invention and various embodiments with various modifications as are suited to the particular use contemplated.

What is claimed as new and desired to be protected by Letters Patent is set forth in the appended claims and includes equivalents of the elements recited therein.

What is claimed is:

1. A method for line-of-sight-independent data transmission in a car-to-car or a car-to-infrastructure communication system, comprising the steps of:

transmitting electromagnetic radiation having encoded data from a transmitter located in a first vehicle or in a traffic infrastructure object;

providing a reflector system in form of a square pyramid or a cube, said square pyramid or cube having at least three passive reflector elements arranged such that the reflector elements form outside surfaces of the square pyramid or the cube and configured to at least partially reflect the transmitted electromagnetic radiation incident on the outside surfaces;

arranging the reflector system with respect to traffic routes that intersect at right angles so that edges of the pyramid or the cube point in a direction of the traffic routes and the transmitted electromagnetic radiation arrives at a receiver located in a second vehicle or in the traffic infrastructure object; and receiving the reflected electromagnetic radiation having the encoded data with the receiver.

2. The method of claim 1, wherein the reflector system is arranged at a location selected from a building bordering a traffic route, a traffic light system, a curve of a traffic route and an intersection of several traffic routes.

3. The method of claim 1, wherein the reflector system is arranged at an intersection of a first and a second traffic route so as to reflect the electromagnetic radiation transmitted substantially in a direction of the first traffic route substantially in a direction of the second traffic route.

4. The method of claim 1, wherein the electromagnetic radiation has a frequency in a range 4 to 7 GHz.

5. The method of claim 4, wherein the electromagnetic radiation has a frequency in a range 5.8 to 6 GHz.

6. The method of claim 5, wherein the electromagnetic radiation has a frequency between 5.85 to 5.925 GHz.

7. A system for line-of-sight-independent data transmission in road traffic, comprising:

a transmitter configured to transmit electromagnetic radiation comprising encoded data, said transmitter disposed in a first vehicle or in a traffic infrastructure project, a receiver configured to receive the electromagnetic radiation, said receiver disposed in a second vehicle or in the traffic infrastructure object, a reflector system in form of a square pyramid or a cube, said square pyramid or cube having at least three reflector elements arranged such that the reflector elements form outside surfaces of the square pyramid or the cube and further arranged with respect to traffic routes that intersect at right angles so that edges of the pyramid or the cube point in a direction of the traffic routes and configured so that the outside surfaces at least partially reflect the transmitted electromagnetic radiation, said reflector system arranged such that the electromagnetic radiation transmitted from the transmitter reaches the receiver.

8. The system of claim 7, wherein at least one of the reflector elements is a two-dimensional reflector element made of metal.

9. The system of claim 8, wherein the two-dimensional reflector element is made from sheet metal.

10. The system of claim 1, wherein the reflector elements forming outside elements of a pyramid have a convex curvature.

11. The method of claim 1, wherein the reflector system formed as a pyramid has a tip pointing vertically toward the road surface.

12. The system of claim 7, wherein the reflector elements forming outside elements of a pyramid have a convex curvature.

13. The system of claim 7, wherein the reflector system formed as a pyramid has a tip pointing vertically toward the road surface.

* * * * *